US006052882A

United States Patent [19]

Campbell et al.

[11] Patent Number: 6,052,882

[45] Date of Patent: Apr. 25, 2000

[54] INSERTION DEVICE FOR INSERTING SPACERS

[75] Inventors: Printess Campbell, Lancaster; J. Richard Clay, Danville, both of Ky.

[73] Assignee: Saturn Tool Company, LLC, Danville, Ky.

[21] Appl. No.: 08/934,466

[22] Filed: Sep. 19, 1997

[51] Int. Cl.[7] ..... B25B 27/00

[52] U.S. Cl. ..... 29/270; 29/809; 29/811.2

[58] Field of Search ..... 29/809, 811.2, 29/270

[56] References Cited

U.S. PATENT DOCUMENTS

| | | | |
|---|---|---|---|
| 2,385,521 | 9/1945 | Mead . | |
| 3,596,821 | 8/1971 | Rogers | 227/138 |
| 3,848,322 | 11/1974 | Kuehn et al. | 29/526 |
| 4,040,164 | 8/1977 | Briles | 29/432 |
| 4,899,438 | 2/1990 | Muller et al. | 29/811 |
| 5,813,114 | 9/1998 | Blacket et al. | 29/809 |

FOREIGN PATENT DOCUMENTS

| | | | |
|---|---|---|---|
| 1955647 | 2/1967 | Germany | 29/809 |

*Primary Examiner*—David P. Bryant
*Assistant Examiner*—Jermie E. Cozart
*Attorney, Agent, or Firm*—Kenneth F. Pearce

[57] ABSTRACT

A device and automated method for inserting spacers into grooves (22). The insertion of spacers into the grooves (22) of wooden doors (20) is particularly useful for aligning parts of the door (20) , such as, panel components and the like of the door (20). Use of the insertion device and method can eliminate the necessity of inserting spacers, by hand, into grooves (22).

22 Claims, 2 Drawing Sheets

FIG 2
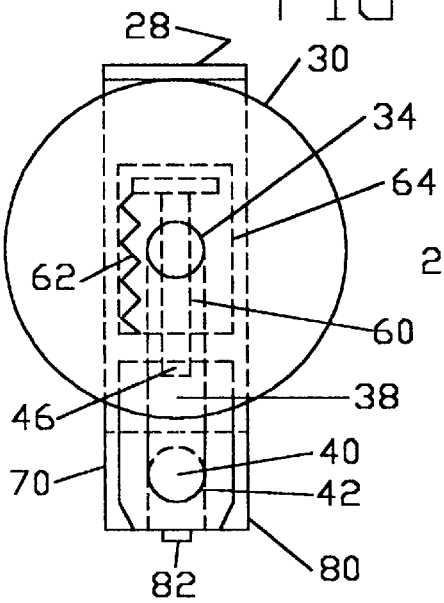
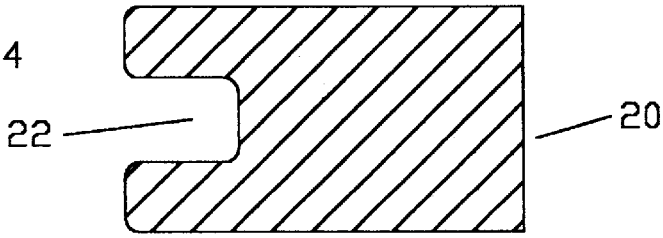
FIG 1
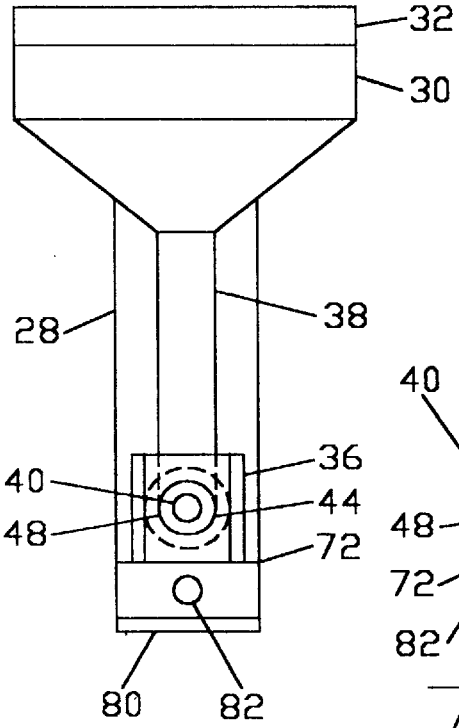
FIG 3
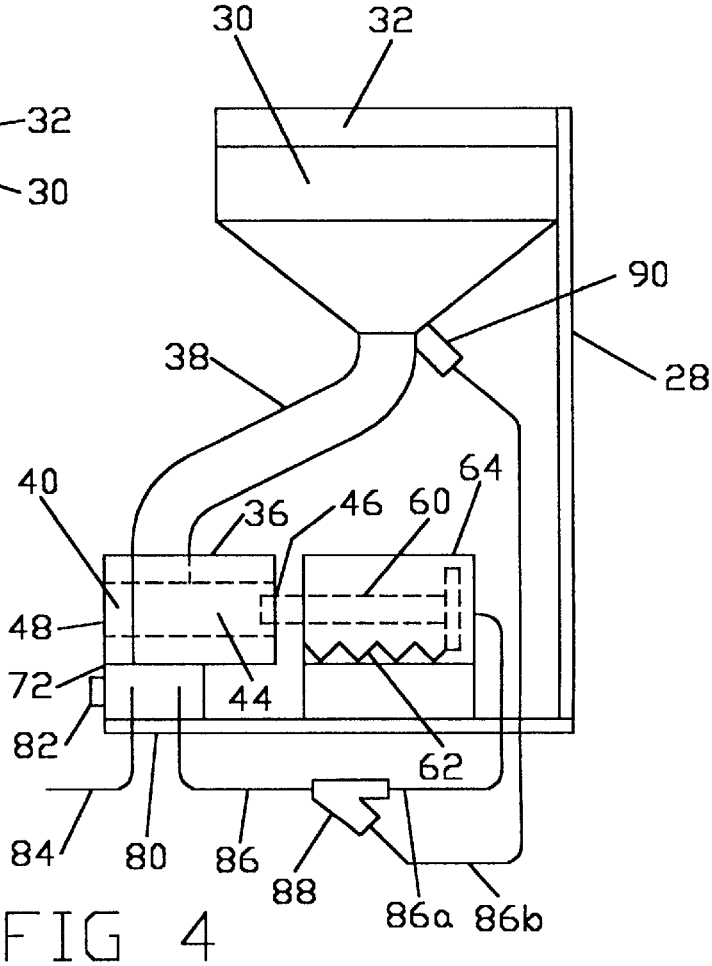
FIG 4

INSERTION DEVICE FOR INSERTING SPACERS

BACKGROUND OF THE INVENTION

1. Field of the Invention

The present invention is directed toward a device and automated method for inserting spacers into the groove of a door. In the art, the unpredictably asymmetrical expansion and contraction of wood requires the use of spacers so that some parts of the door, such as, panels and the like are kept in proper alignment. Prior to the present invention, it is believed that spacers were inserted, by hand, into the grooves. Although it has been determined that the present invention is particularly useful in the cabinet door arts, one or more embodiments of the device and method can easily be adapted to insert a spacer into any groove, regardless of whether the workpiece is a door. Within the scope of the present unity of invention, mechanical, pneumatic or various combined embodiments thereof and methods therefor can be utilized to insert spacers into grooves.

2. Description of the Previous Art a) U.S. Pat. No. 2,385,521-Mead discloses a machine having a magazine loaded with workpieces. Preferably, the workpieces are shaped as discs. The Mead apparatus first feeds and then holds a disc for a drill press to bore a hole through the workpiece. After the boring is completed, the device advances the finished disc while feeding another unfinished workpiece into the holding position.

b) U.S. Pat. No. 5,317,853-Lopes requires a plurality of spheres of limitedly compressible resilient material to be disposed in the grooves of the vertical styles and horizontal rails forming the frame of the door. Mortise and tenon joints urge the central panel toward the spheres contained in the grooves of the styles and rails. For its utility, Lopes mandates a completed cabinet door having a plurality of spheres in its frame. Interestingly, U.S. Pat. No. 5,317,853 is completely silent regarding how the plurality of spheres is placed in the cabinet door frame.

SUMMARY OF THE INVENTION

The present unity of invention includes devices and automated methods for inserting spacers into grooves. It is believed that prior to the present invention, the spherical spacers were inserted, by hand, into the grooves. As indicated previously, due to the unpredictable expansion and contraction of wood, the spacers insure proper alignment for some parts of the doors. The long felt but previously unfilled need for speedier insertion of spacers into the grooves is met by either the benchtop or handheld embodiments and the method for utilizing either of them.

An object of the present invention is to provide a device for inserting a spacer into a groove.

Another object of the present invention is to provide a device capable of rapidly inserting spacers into grooves.

Yet another object of the present invention is to provide an automated method for inserting spacers into grooves.

Still another object of the present invention is to provide an automated method for rapidly inserting spacers into grooves.

Yet another object of the present invention is to provide a device particularly useful in the door industry.

It is another object of the present invention to provide a handheld device for inserting spacers.

It is yet another object of the present invention to provide a tabletop device for inserting spacers.

It is still another object of the present invention to provide a manually operated device for inserting spacers.

Yet still another object of the present invention to provide a mechanically assisted device for inserting spacers.

It is still another object of the present invention to provide a pneumatically assisted device for inserting spacers.

Yet another object of the present invention is to provide a device and method for inserting spacers capable of utilizing either mechanical or pneumatic energy or selected combinations thereof for actuation and insertion.

Still another object of the present invention to provide a handheld device for inserting spacers capable of utilizing either mechanical or pneumatic energy or selected combinations thereof for actuation and insertion.

It is still another object of the present invention to provide a device for inserting a pliable spheroid-type spacer.

It is yet another object of the present invention to provide a device for inserting spacers into either the grooves of a door or into the preselected grooves of parts of the door which are eventually combined into the completed door.

As used herein, "spacer" shall mean any tangible object which is inserted into a groove. One or more spacers can be inserted into any groove.

A first embodiment of the present invention can be described as a device for inserting a spacer into a groove of a door, comprising: a reservoir for holding spacers attached to a rest having a channel therethrough cooperating with a hammer for expelling spacers out of the channel, and an actuator for activating the hammer. Another embodiment of the present invention can be described as a device for inserting a spacer into a groove of a door, comprising: a reservoir for holding spacers attached to a chamber, and a hammer for expelling the spacer out of the chamber and through a cylinder. Another embodiment in accord with the solidarity of the present invention includes the method comprising the step of: non-manually inserting the spacer into the groove.

It is the novel and unique interaction of these simple elements and steps which creates embodiments within the ambit of the present unity of invention. Pursuant to Title 35 of the United States Code, descriptions of preferred embodiments follow. However, it is to be understood that the best mode descriptions do not limit the scope of the present invention. The breadth of the present invention is identified in the claims appended hereto.

BRIEF DESCRIPTION OF THE DRAWINGS

FIG. 1 is a cross-sectional view of a groove of a part of a door.

FIG. 2 is top view of a first embodiment of the present invention.

FIG. 3 is a frontal view of the first embodiment of the present invention.

FIG. 4 is a side view of the first embodiment of the present invention.

DESCRIPTION OF THE PREFERRED EMBODIMENTS

Figure 7:
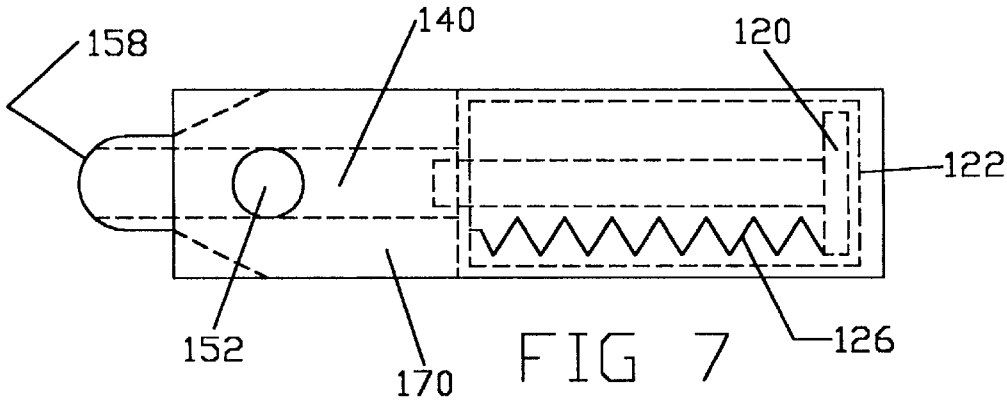
FIG. 7 is a top view of a second embodiment of the present invention.

Although the disclosure hereof is detailed to enable those skilled in the art to practice the invention, the embodiments published herein merely exemplify the present invention which can be practiced in other specific structures.

Beginning with FIG. 1, as an instructive point of reference, a cross-section of a part of door or door (20) having groove (22) therein is shown. As previously disclosed, the insertion device can insert a spacer (not shown) into any groove, but the present invention is particularly adapted for use in the wood door industry. When practicing the present invention, spacer (not shown) is inserted into groove (22). And it has been determined that pliable spheroids are compatible with any specific adaptation of any of the embodiments of the insertion device. Further, any of the invention's elements of the various embodiments can be constructed of any materials suitable in the art, including but not limited to metals, plastics, or preselected combinations thereof.

Turning toward FIGS. 2, 3 and 4, holder (28) supports reservoir (30) for holding a plurality of spacers (not shown). Reservoir (30) can be covered by lid (32). In this specific adaptation, reservoir (30) is shaped so that gravity will pull the spacers (not shown) downward toward rest (36) through connector (38). By way of example, connector (38) can be a plastic tube. While not disclosed specifically in this particular embodiment, those skilled in the art understand that reservoir (30) can be shaped with dimensions so that it can be set directly above rest (36), thereby eliminating the necessity for connector (38).

Rest (36) has channel (40) therethrough. In this specific adaptation of this embodiment, channel (40) can best be described as being formed in the shape of an upside-down T. Those skilled in the art will recognize that channel (40) can be sized to facilitate the movement of pliable spheroids of any preselected volumetric capacity. Thus, the present invention can easily accommodate the insertion of spacers of any dimension into any size groove.

Connector (38) feeds spacers (not shown) from opening (34) of reservoir (30) into top (42) of channel (40). Top (42) has been contoured to allow only one spacer at a time to enter bottom (44) of channel (40). End (46) of bottom (44) receives hammer (60) which when actuated expels a spacer (not shown) through bottom (44) out of aperture (48) and into groove (22). Spring (62) returns hammer (60) to its resting position after the spacer has been expelled. Although the present embodiment can be modified to accommodate manual actuation of hammer (60), the preferred practice utilizes compressed air to power hammer (60). When enclosing hammer (60) in case (64) and applying air pressure, a single-acting pneumatic piston is created, in accordance with the present invention which expels the spacers through channel (40) and into groove (22). Importantly, any commercially available single-acting piston capable of reciprocating with end (46) of channel (40) while sustaining repetitive actuation at pressures utilized when practicing the present invention can be incorporated with this embodiment.

In the particular adaptation disclosed in FIGS. 2–4, channel (40) and case (64) are shown as separate units. However, those skilled in the art can appreciate that channel (40) and case (64) could be easily combined both structurally and compartmentally into a single operative actuating/hammering unit, but as shown in FIGS. 2–4, base (70) supports rest (36), case (64) and switch (80). Further, base (70) can be equipped with guide (72) for aligning groove (22) with aperture (48) of bottom (44) of channel (40) of rest (36).

Turning now with a specific view toward FIG. 4, line (84) connects actuator (80) with source of pneumatic pressure (not shown). The source of pneumatic pressure can be any of those commercially available devices which can accommodate pressure ranges from about 200 kiloPaschals to about 900 kiloPaschals. Actuator (80) is provided with trip button (82). When button (82) is depressed, actuator (80) vents air pressure into conduit (86). In this particular adaptation of the present invention, y-joint (88) further divides conduit (86) into sections (86*a*) and (86*b*). Section (86*a*) carries pressure to case (64) for powering hammer (60) to expel a spacer (not shown) through channel (40) and out of aperture (44) into groove (22) of door (20). Y-joint (88) also transfers pressure into section (86*b*) which leads to opening (90) of reservoir (30). The air pressure transferred to reservoir (30) agitates the plurality of spacers (not shown) thereby insuring that another spacer enters connector (38).

In operation, when a part of door (20) having its groove (22) facing aperture (44) of channel (40) depresses button (82), actuator (80) transfers air pressure into sections (86*a*) and (86*b*) which simultaneously agitates a plurality of spacers in reservoir (30) while activating hammer (60) to expel a spacer through channel (40) and into awaiting groove (22). It is the novel, nonobvious and unique interaction between these simple elements that creates this embodiment within the ambit of this invention.

Figure 6:
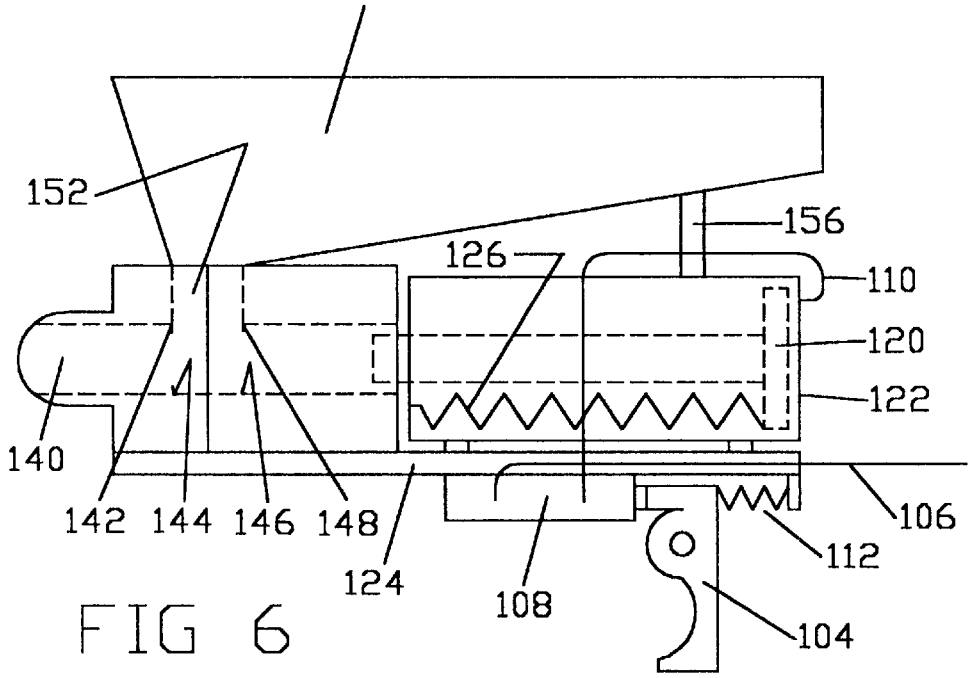
FIG. 6 is cutaway view from the side of a second embodiment of the present invention.
Figure 5:
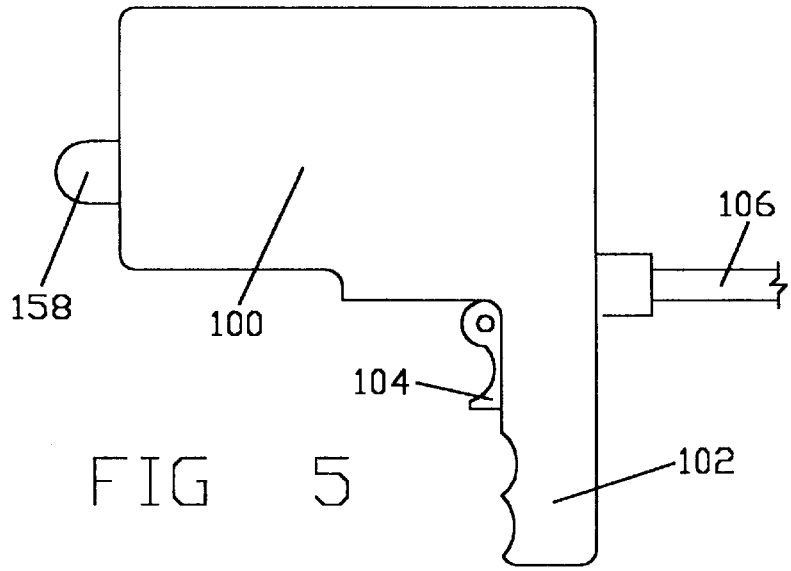
FIG. 5 is a side view of a second embodiment of the present invention.

Viewing FIGS. 5, 6 and 7, another embodiment of the present invention is disclosed. In this particular adaptation, air pressure powers the device. However, those skilled in the art understand that the insertion of spacers into the grooves of doors can also be accomplished by utilizing a mechanical plunger-type gun or a spring powered mechanism.

With reference to FIGS. 5 and 6, extending from housing (100) is cylinder (140) and depending from housing (100) is grip (102). Grip (102) further includes trigger (104) for actuating the invention while spring (112) assists trigger (104) in maintaining its inactivated position. Also connected to housing (100) is conduit (106) for supplying air pressure from a pneumatic source (not shown) to valve (108).

Valve (108) is best seen in FIGS. 5 and 6, and any commercially available valve capable of functioning in the pressure ranges of about 200 kiloPaschals to about 900 kilopaschals can be utilized with the present invention. When trigger (104) is compressed toward grip (102), pneumatic pressure flowing through conduit (106) enters valve (108) which also transfers pressure through line (110) and into casing (122) housing hammer (120). The combination of casing (122) and hammer (120) create a pneumatic piston for expelling the spacer (not shown) from cylinder (140) into groove (22) of door (20). Additionally, casing (122) is provided with spring (126) to assist in returning hammer (120) to its inactivated position.

Valve (108) and trigger (104) are attached to base (124) while casing (122) as well as jacket (130) rest on base (124). As disclosed in FIGS. 6 and 7, jacket (130) encloses cylinder (140). Passage (152) connects cylinder (140) with reservoir (170) which holds a plurality of spacers (not shown). Additionally, passage (152) can be contoured so that the subsequent spacer (not shown) cannot enter chamber (150), until the previous spacer (not shown) is expelled through cylinder (140). Rod (156) raises reservoir (170) at an angle to assist gravity-feeding of spacers into chamber (150). Although not shown, the pneumatics associated with the present invention can both load the spacer into the chamber while also expelling the spacer through the cylinder and into the groove of the door. Moreover, in this specific adaptation pliable spheroidal spacers are particularly useful. Importantly, the sizes of the spacer, as well as chamber (150)

and/or cylinder (140) or any variation thereof can be modified appropriately depending upon the size of groove into which the spacer is to be inserted.

Looking toward FIG. 6, chamber (150) is defined by stops (142), (144), (146) and (148). The stops prevent the spacer from falling out of cylinder (140), before hammer (120) can expel the spacer into groove (22). However, cylinder (140) can be made in such dimension so as to eliminate the stops, thus the cylinder, in effect, is also the chamber. For ease of use in a commercial setting, cylinder (140) can be provided with a convex tip (158) to assist the maneuvering of the present invention while it rides above door (20).

In operation, trigger (104) actuates valve (108) thereby forcing hammer (120) to expel the spacer out of chamber (150) through cylinder (140) and into groove (22) of door (20). It is the novel and unique interaction between these simple elements which forms the essence of this particular embodiment.

In accord with the unity of the present invention, any of the devices disclosed in FIGS. 2–7 can be utilized to practice the step of non-manually inserting the spacer (not shown) into groove (22) of door (20). Further, when practicing the present method, more than one spacer can be rapidly introduced into groove (22). As previously identified, mechanical or pneumatic forces or any combination thereof energize the practice of the present method. In other words, a device utilizing any of the aforenoted types of forces introduces the spacer into the groove. And practice of the present method, eliminates the requirement of an individual inserting the spacer, by hand, which has been the standard practice in the industry.

Having disclosed the invention as required by Title 35 of the United States Code, Applicant now prays respectfully that Letters Patent be granted for his invention in accordance with the scope of the claims appended hereto.

What is claimed is:

1. A freestanding insertion device for inserting a pliable spheroid into a groove of a panel in which said groove has a width less than a circumference of said pliable spheroid. wherein, after insertion, said pliable spheroid is sufficiently decompressed to be contiguous with expansion and contraction of said groove such that said pliable spheroid is seated in said groove, said device comprising:

a) a reservoir attached to and suspended above a freestanding rest against which said groove is positioned to receive said pliable spheroid;

b) said rest further comprising an annular channel there through of a dimension greater than a volumetric capacity of said pliable spheroid such that gravity delivers said pliable spheroid from said reservoir through a top of said annular channel to a bottom of said annular channel;

c) said annular channel further including an end circumscribing a hammer opposite; said hammer coaxially aligned with an aperture located opposite said end, wherein said aperture has a greater circumference than said pliable spheroid through which said hammer pushes said pliable spheroid for expulsion from said bottom and insertion into said groove; and d) a plurality of pliable spheroids contained in said reservoir.

2. The invention of claim 1 wherein said hammer is pneumatically activated by a pneumatic actuator.

3. The invention of claim 2 wherein pressure, in the range of from about 200 kiloPaschals to about 900 kiloPaschals, actuates said pneumatically actuated hammer.

4. The invention of claim 3 further comprising a conduit for simultaneously agitating said plurality of spheroids and actuating said pneumatically actuated hammer to push said pliable spheroid for insertion into said groove.

5. The invention of claim 4 further comprising a base for said rest.

6. The invention of claim 5 further comprising a guide.

7. A hand held insertion device for inserting a pliable spheroid into a groove of a panel in which said groove has a width less than a circumference of said pliable spheroid, wherein, after insertion said pliable spheroid is sufficiently decompressed to be contiguous with expansion and contraction of said groove such that said pliable spheroid is seated in said groove, said device comprising:

a) an angled reservoir communicating with and suspended above a contoured passage of a cylinder wherein said contoured passage is fitted to a volumetric capacity proportional to said pliable spheroid for gravity feeding said pliable spheroid from said reservoir to an annular chamber;

i) said cylinder further including an annular end of greater circumference than said pliable spheroid for riding against said groove, as said pliable spheroid is inserted into said groove; and ii) said annular chamber further dimensioned to releasably retain said pliable spheroid therein;

b) a hammer coaxially aligned with said annular end of said cylinder for expelling said pliable spheroid out from said chamber and into said groove such that said pliable spheroid partially decompresses, when installed in said groove;

c) a grip;

d) a base supporting said reservoir, said cylinder and said grip; and e) a plurality of pliable spheroids contained in said reservoir.

8. The invention of claim 7 wherein said hammer is pneumatically actuated.

9. The invention of claim 8 wherein pressure, in the range of from about 200 kiloPaschals to about 900 kiloPaschals, actuates said pneumatically actuated hammer.

10. The invention of claim 9 wherein said grip further includes a trigger.

11. The invention of claim 10 wherein said annular end is convex.

12. The invention of claim 11 wherein said reservoir is raised at an angle by a rod.

13. A freestanding insertion device for inserting a pliable spheroid into a groove of a panel in which said groove has a width less than a circumference of said pliable spheroid, wherein, after insertion, said pliable spheroid is sufficiently decompressed to be contiguous with expansion and contraction of said groove such that said pliable spheroid is seated in said groove, said device comprising:

a) a reservoir attached to and suspended above a freestanding rest against which said groove is positioned to receive said pliable spheroid;

b) said rest further comprising an annular channel there through of a dimension greater than a volumetric capacity of said pliable spheroid such that gravity delivers said pliable spheroid from said reservoir through a top of said annular channel to a bottom of said annular channel;

c) said annular channel further including an end circumscribing a hammer opposite; said hammer coaxially aligned with an aperture located opposite said end, wherein said aperture has a greater circumference than said pliable spheroid through which said hammer pushes said pliable spheroid for expulsion from said bottom and insertion into said groove; and d) a base.

14. The invention of claim 13 further comprising a guide.

15. The invention of claim 14 wherein said hammer is wherein said reservoir is suspended directly above said freestanding rest.

16. The invention of claim 15 wherein said hammer is pneumatically activated by a pneumatic actuator.

17. The invention of claim 16 wherein wherein pressure, in the range of from about 200 kiloPaschals to about 900 kiloPaschals, actuates said pneumatically actuated hammer.

18. The invention of claim 17 further comprising a connector for conveying said pliable spheroid from said reservoir to said channel.

19. A freestanding insertion device for inserting a pliable spheroid into a groove of a panel in which said groove has a width less than a circumference of said pliable spheroid, wherein, after insertion, said pliable spheroid is sufficiently decompressed to be contiguous with expansion and contraction of said groove such that said pliable spheroid is seated in said groove, said device comprising:

a) a reservoir attached directly above a freestanding rest against which said groove is positioned to receive said pliable spheroid;

b) said rest further comprising an annular channel there through of a dimension greater than a volumetric capacity of said pliable spheroid such that gravity delivers said pliable spheroid from said reservoir through a top of said annular channel to a bottom of said annular channel;

c) said annular channel further including an end circumscribing a hammer; said hammer coaxially aligned with an aperture opposite said end wherein said aperture has a greater circumference than said pliable spheroid through which said hammer pushes said pliable spheroid for expulsion from said bottom and insertion into said groove;

d) a base; and e) a guide for said panel.

20. The invention of claim 19 wherein said hammer is pneumatically activated by a pneumatic actuator.

21. The invention of claim 20 wherein pressure, in the range of from about 200 kiloPaschals to about 900 kiloPaschals, actuates said pneumatically actuated hammer.

22. The invention of claim 21 further comprising a connector for conveying said pliable spheroid from said reservoir to said annular channel.

* * * * *